United States Patent [19]

Benson et al.

[11] Patent Number: 4,976,200

[45] Date of Patent: Dec. 11, 1990

[54] TUNGSTEN BRIDGE FOR THE LOW ENERGY IGNITION OF EXPLOSIVE AND ENERGETIC MATERIALS

[75] Inventors: David A. Benson; Robert W. Bickes, Jr.; Robert S. Blewer, all of Albuquerque, N. Mex.

[73] Assignee: The United States of America as represented by the United States Department of Energy, Washington, D.C.

[21] Appl. No.: 292,201

[22] Filed: Dec. 30, 1988

[51] Int. Cl.[5] ..... F42B 3/10

[52] U.S. Cl. ..... 102/202.7; 102/202.9

[58] Field of Search ..... 102/202.5, 202.7, 202.9, 102/202.14

[56] References Cited

U.S. PATENT DOCUMENTS

| | | | |
|---|---|---|---|
| 3,669,022 | 6/1972 | Dahn et al. | 102/28 EB |
| 3,682,096 | 8/1972 | Ludke et al. | 102/28 R |
| 3,974,424 | 8/1976 | Lee | 317/80 |
| 4,428,292 | 1/1984 | Riggs | 102/202.7 |
| 4,484,523 | 11/1984 | Smith et al. | 102/202.5 |
| 4,586,435 | 5/1986 | Bock | 102/202.5 |
| 4,708,060 | 11/1987 | Bickes, Jr. et al. | 102/202.7 |
| 4,729,315 | 3/1988 | Proffit et al. | 102/202.5 |
| 4,796,562 | 1/1989 | Brors et al. | 219/405 |
| 4,819,560 | 4/1989 | Patz et al. | 102/202.5 |

OTHER PUBLICATIONS

R. Blewer et al., "Thick Tungsten Films In Multilayer Conductor Systems: Properties and Deposition Technique", 1984 Proceedings, First International IEEE VLSI Multilevel Interconnection Conference, New Orleans, LA, Jun. 21-22, 1984, pp. 153-158.

R. Smith et al., "Design of Solid-State Film-Bridge Detonators with Heat Transfer Calculations for Film--Bridge and Hot-Wire Electro-Explosive Devices", NWC TP 6448, Sep. 1983, pp. 1-97.

*Primary Examiner*—Charles T. Jordan
*Assistant Examiner*—Richard W. Wendtland
*Attorney, Agent, or Firm*—George H. Libman; James H. Chafin; William R. Moser

[57] ABSTRACT

A tungsten bridge device for the low energy ignition of explosive and energetic materials is disclosed. The device is fabricated on a silicon-on-sapphire substrate which has an insulating bridge element defined therein using standard integrated circuit fabrication techniques. Then, a thin layer of tungsten is selectively deposited on the silicon bridge layer using chemical vapor deposition techniques. Finally, conductive lands are deposited on each end of the tungsten bridge layer to form the device. It has been found that this device exhibits substantially shorter ignition times than standard metal bridges and foil igniting devices. In addition, substantially less energy is required to cause ignition of the tungsten bridge device of the present invention than is required for common metal bridges and foil devices used for the same purpose.

16 Claims, 2 Drawing Sheets

TUNGSTEN BRIDGE FOR THE LOW ENERGY IGNITION OF EXPLOSIVE AND ENERGETIC MATERIALS

The present invention relates generally to bridges for igniting explosive materials, and more particularly to a tungsten bridge which may be used as a low-energy igniter for explosive devices. The Goverment has rights in this invention pursuant to Contract No. DE-AC04-76DP00789, between the U.S. Department of Energy and AT&T Technologies, Inc.

BACKGROUND OF THE INVENTION

Electro-explosive devices fall into one of two basic groups. The first group is electro-thermally initiated devices which respond to relatively low electrical energies. The second group is electro-shock initiated devices which include exploding wire and foil designs requiring very high energy levels.

The shock initiated devices have the advantages of fast and repeatable function times. The shock initiated devices also exhibit a very high resistance to inadvertent initiation. However, high initiation energies and power levels are normally required which lead to larger and more expensive electrical firing systems.

The electro-thermally initiated group have not matched the inherent input safety characteristics or response time of the shock-initiated devices. Typical response times for the thermally-initiated devices range from about 5 microseconds to several milliseconds, while the shock-initiated electro-explosive devices respond in less than 1 microsecond. However, shock-initiated devices typically require larger and more expensive firing circuits for initiation because they use higher electrical voltages and dissipate to higher power levels.

In order to obtain environmental tolerance along with acceptable shelf-life, electro-explosive devices are usually designed with hermetically sealed housings with electrical feed-throughs. Additionally, thermally-initiated devices must be able to withstand reasonable, unintended currents without firing since relatively low energies are required to cause firing of the devices. Any current will produce some heating of the bridge wire and most designs of thermally-initiated devices have limited cabability to conduct this heat away from the thermally sensitive explosive. Prior art methods for preventing inadvertent firing of the thermally-initiated devices include using a large diameter bridge wire and thermally-conductive header dielectrics. This also tends to extend the explosive function time and is undesirable for many applications.

There are several examples of metal thin film bridges in the prior art. For example, U.S. Pat. No. 4,484,523 (Smith, et al.) issued on Nov. 27, 1984, discloses a semiconductor detonator comprising a thick film bridge. However, a non-selectively deposited chromium-silicon film is used as the metal film layer.

U.S. Pat. No. 3,974,424 (Lee) issued on Aug. 10, 1976, discloses a variable resistance metal foil bridge element for electro-thermal devices. The resistance element is generally S-shaped and has two arcuate resistor portions which are joined by a connector portion. The effective resistance of the bridge element may be varied by changing the points at which the connection to the lead wires is made.

Blewer, R. S. and Wells, V. A., "Thick Tungsten Films in Multi-layer Conductor Systems: Properties and Deposition Techniques", 1984 Proceedings, First International IEEE VLSI Multi-level Interconnection Conference, New Orleans, La., 1984, discloses techniques for depositing thick films of tungsten onto metal and silicon surfaces. However, this publication does not disclose a method for fabricating a thin-film bridge device.

U.S. Pat. No. 3,669,022 (Dahn, et al.) issued on Jun. 13, 1972, discloses a thin-film bridging device which may be used as a fuse. The device includes a pair of conductive layers separated and joined to opposite faces of a thin insulating layer to thereby form a three-layer sandwich. The sides of each layer are coated by a bridge element of low-density, low-specific heat metals so as to short-circuit or bridge the conductive layers.

U.S. Pat. No. 3,682,096 (Ludke, et al.) issued on Aug. 8, 1972, discloses an electric detonator in which an incandescent bridge intended to set off a charge is formed on one side of a non-conductive carrier which is inserted into a conductive housing and which rests on its side opposite the bridge.

U.S. Pat. No. 4,586,435 (Bock) issued on May 6, 1986, discloses an electric detonator. In FIG. 4 of that patent, a fuse unit is shown which uses a tungsten filament. However, tungsten is not used as a bridging film element in this detonator, nor is it a supported thin-film structure.

U.S. Pat. No. 4,428,292 (Riggs) issued on Jan. 31, 1984, discloses a high-temperature exploding bridge wire detonator and explosive composition. The patent is primarily directed to an explosive composition, although it does disclose that the composition can be initiated by an exploding bridge wire or an electro-static discharge of sufficient energy.

Thus, there is a need in the art for metal film bridge devices which require less energy and which do not fire inadvertently as a result of electro-static discharge. In addition, there is a need in the art for metal film bridge devices which are simple to manufacture and which can be mass-produced.

SUMMARY OF THE INVENTION

The present invention relates to a tungsten bridge device for the low-energy ignition of explosive and energetic materials. The device includes a substrate covered by a silicon dioxide or other insulating layer, a bridge on the surface of the insulator and a pair of lands deposited over the bridge. The bridge includes a first layer in contact with the substrate and comprising silicon and a second layer over said first layer which includes tungsten. The conductive lands are deposited over the tungsten layer and are spaced from each other. Finally, a pair of electrical conductors are each connected to one of the lands and a power source is connected to the electrical conductor for supplying current to the lands.

The present invention also relates to a method of manufacturing metal film bridge devices for the ignition of explosive and energetic materials. The method includes the steps of defining a bridge shape on a silicon substrate, depositing a layer of tungsten of sufficient thickness to obtain the desired bridge resistance over the bridge shape, and depositing a pair of conductive lands over the tungsten layer such that the lands are spaced apart one from another.

It is the primary object of the present invention to provide a metal film bridge igniter which requires substantially less energy for ignition than other metal film bridge igniters.

It is a further object of the present invention to provide a method of manufacturing metal film bridge igniters which will permit cost-effective mass-production of the bridge.

It is a still further object of the present invention to provide a metal film bridge igniter which does not require a highly-doped silicon element and hence offers an alternative method of explosive ignition.

It is a still further object of the present invention to provide a method of manufacturing metal film bridge igniters which does not require the use of physical masks and thus more precise, reproducable results can be obtained and small bridges can be simply fabricated.

It is a still further object of the present invention to provide a metal film bridge igniter including a high atomic weight material which enhances heat transfer to an explosive powder.

These and other objects of the present invention will be apparent to one of ordinary skill in the art from the detailed description which follows.

DETAILED DESCRIPTION OF THE PREFERRED EMBODIMENT

Figure 1:
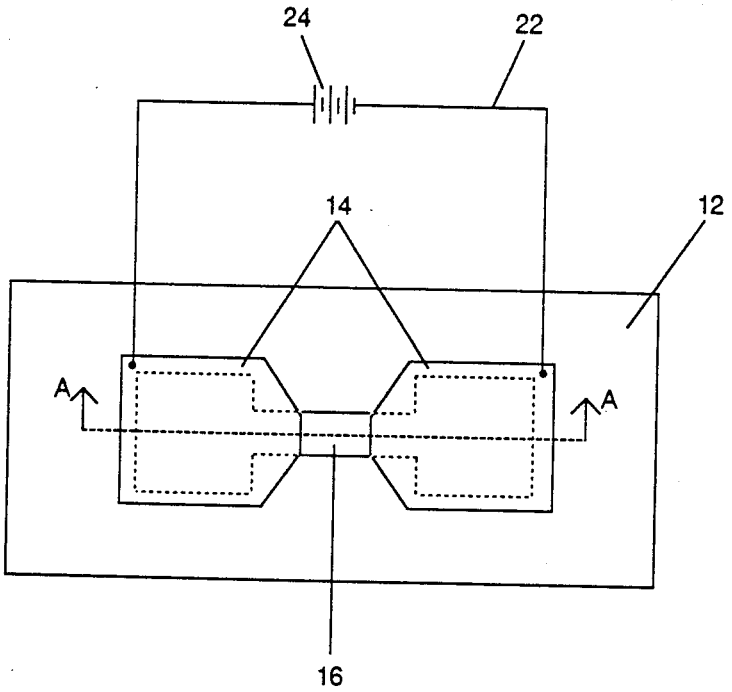
FIG. 1 is a plan view of a tungsten bridge in accordance with the present invention.

Referring now to FIG. 1, there is shown a plan view of a tungsten bridge device in accordance with the present invention. The device includes a substrate 12 having a tungsten clad silicon bridge 16 (shown partially in dotted outline) thereon. Atop both ends of tungsten clad silicon bridge 16 are deposited metal lands 14 each of which is connected by lead wires 22 to power source 24.

Figure 2:
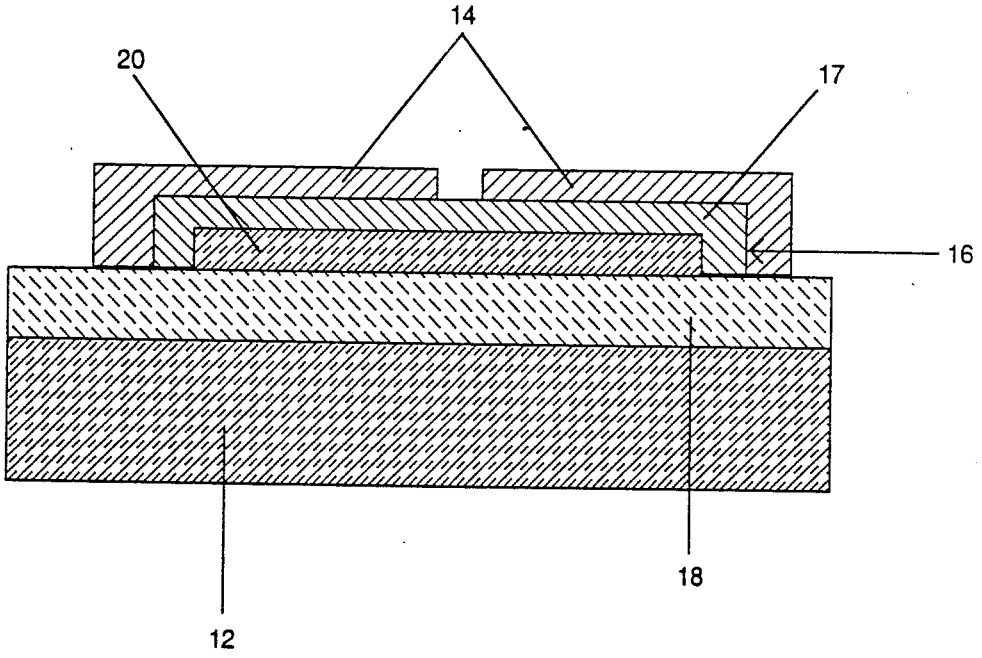
FIG. 2 is a cross-sectional view along line A—A of FIG. 1.

Referring now to FIG. 2, there is shown a cross-sectional view through line A—A of FIG. 1. In FIG. 2, substrate 12 can be seen more clearly. On the surface of substrate 12 is an oxide insulator layer 18. A patterned silicon bridge layer 20 is located above insulator layer 18 and tungsten layer 17 is clad on the exposed surfaces (top and sides) of silicon layer 20. Finally, metal lands 14 are deposited on top of tungsten layer 17.

The device is preferably manufactured from intrinsic silicon-on-sapphire wafers on which the desired bridge shape is first defined in the silicon layer using standard integrated circuit device fabrication techniques. The shape of silicon bridge layer 20 determines the width of the finished bridge. Next, tungsten layer 17 is deposited onto silicon layer 20 to the thickness required to obtain the desired bridge resistance. Finally, metal lands 14 are deposited over the ends of the tungsten/silicon bridge 16. The substrate 12 is then cut and diced to yield several hundred chips each containing a tungsten bridge.

Patterned silicon-on-sapphire structures are known to those of ordinary skill in the art, and any suitable wafer containing silicon-on-sapphire structures may also be used to fabricate the bridge of the present invention. The silicon-on-sapphire structure wafers act as substrate-insulator-silicon layers 12-18-20.

Undoped silicon is suitable for use as both the substrate 12 and silicon bridge layer 20 although other insulating materials known in the art are suitable. Doped silicon may also be used but undoped silicon is preferable since it is less expensive to manufacture and since doped silicon is not required for the igniter of the present invention to function effectively. The desired bridge shape is defined in the silicon layer using standard integrated circuit fabrication techniques which are known to those of ordinary skill in the art. Further, doping silicon to desirably high concentrations (for lower electrical resistivity) generally requires long implantation times and constrains the range of subsequent fabrication process options and is thus undesirable in the present device. In contrast, the tungsten clad silicon design uses material of much greater conductivity (i.e., a metal). In addition, the bridge can be simply and easily fabricated at low temperature using a selective chemical vapor deposition (C.V.D) process. This process allows the metal to be deposited in a self-aligned fashion on the silicon bridge without the masking steps usually required to define the shape of conventional thin film metalization. Furthermore, the metal is not as sensitive to the temperature coefficient of resistance as is a doped semiconductor. The silicon bridge structure should range from about 1 to about 5 micrometers in thickness and more preferably from about 1.5 to about 3 micrometers in thickness. In addition, the silicon bridge layer preferably electrically insulates tungsten layer 17 from the underlying substrate.

A conformal, self-aligning tungsten layer 17 is deposited over silicon bridge layer 20 preferably using selective low pressure, chemical vapor deposition techniques. Tungsten layer 17 is deposited to the thickness required to obtain the desired bridge resistance. Normally, the bridge resistance is less than about 10 ohms, more preferably from about 0.1 ohms to about 8 ohms, and most preferably from about 1 to about 5 ohms. Typical tungsten thicknesses will be on the order of 0.1 to about 1 micrometer. A more-detailed description of tungsten film deposition techniques can be found in "Thick Tungsten Films in Multi-layer Conductor Systems: Properties and Deposition Techniques", Blewer, R. S., et al., 1984 Proceedings, First International IEEE VLSI Multi-level Interconnection Conference, New Orleans, La., Jun. 21–22, 1984, the disclosure of which is hereby incorporated by reference.

Finally, aluminum or other highly conductive metal lands 14 are deposited over each end of tungsten layer 17. Lands 14 provide a means for electrical input to the bridge. Lead wires 22 are attached to the lands and current flows through the lead wires to the lands and across the bridge.

The device of the present invention ignites explosive materials using a thin-film tungsten or tungsten compound (or alloy) bridge. High speed framing photographs of the tungsten bridge show that application of a current pulse to the bridge via the aluminum lands produced a lateral burn pattern, similar to the polysilicon semi-conductor bridges, which produced an intense plasma that was sustained while the current was applied. It was found that this plasma discharge is a suitable ignition source for explosive and energetic materials.

The tungsten bridges of the present invention were assemblerd into test devices filled with a pyrotechnic powder. Experiments demonstrated that the bridge could ignite the powder at energies less than 10 mJ. That energy is approximately one-third the energy for metal wire and film bridges known in the prior art. In addition, the function times for the devices of the present invention ranged from 25 to 75 microseconds, a factor of 100 faster than conventional metal bridges and foils.

The tungsten bridge devices of the present invention are manufactured by a new selective deposition method of manufacturing metal film igniters which lends itself to cost-effective mass-production techniques which are characteristic of current integrated circuit technology. Both integrated circuit fabrication technology and chemical vapor deposition techniques can be accomplished on a large scale with highly reproducible results. Accordingly, both the manufacturing yield and electrical performance of the devices of the present invention are much improved compared to conventional wire and film igniters. Further, the tungsten bridge devices have excellent no-fire characteristics and are resistant to electrostatic discharge ignition because of the low bridge resistance, the refractory nature of tungsten and the high efficiency of thermal conduction to the substrate. The tungsten bridge devices will ignite explosive powders at substantially less energy than presently required for ordinary wire bridges and metal foils and the tungsten bridge device can be made much smaller than conventional bridges and foils since integrated circuit fabrication and chemical vapor deposition techniques allow fabrication of the device on an extremely small scale.

The tungsten bridge ignition devices may be used in several different explosive devices including actuators, squibbs, igniters and other hot-wire like devices. It is also anticipated that the units will be useful in commercial explosive devices. Finally, the tungsten bridges can also be used as a miniature plasma source which radiates with the characteristics of high atomic weight materials.

In operation, current is applied to metal lands 14 via lead wires 22. The current will heat tungsten bridge 16 to create current carrying channels. The discharge produces a lateral burn pattern initially, much like the polysilicon semi-conductor bridge designs, and quickly progresses to an intense plasma event or discharge which lasts for the duration of the driven current pulse. The intense plasma event vaporizes both the tungsten and the silicon layer of the bridge. The tungsten provides the initial heating of the composite bridge, and once the silicon is heated to the point of intrinsic conduction, it too participates in the discharge process increasing the plasma density. Observations made subsequent to testing indicate that the silicon bridge material is cleanly removed from the bridge region by the plasma event.

It has been found that the bridge behaves well under both firing and subthreshold conditions. More particularly, the bridge does not suffer from a premature fuse type burnout of the tungsten element prior to forming the conductive plasma event as is common with other types of metal bridges. In addition, the tungsten layer 17 on the bridge can be fabricated to produce low resistance levels and thereby reduce the possibility of electrostatic discharge ignition of the device. Configuration of bridge geometry area or thickness of the tungsten film to lower the initial resistance to approximately one ohm significantly reduces the possibility of electrostatic discharge ignition.

The following examples of the present invention are presented for illustration and description.

EXAMPLE 1

This example illustrates the manufacturing process used to fabricate tungsten bridges in accordance with the present invention.

A conventional intrinsic silicon-on-sapphire wafer was selected as the substrate of the present invention. The desired bridge shape was then defined in the silicon layer using standard integrated circuit device lithographic patterning techniques. A silicon bridge layer of 2 micrometers thicknes was thus fabricated. Then, a layer of tungsten 0.28 micrometers in thickness was conformally deposited over the silicon bridge layer using chemical vapor deposition techniques. More particularly, the tungsten film was deposited on the silicon semiconductor bridge structure using a hot-wall quartz-tube, low-pressure chemical vapor deposition reactor. A deposition temperature of 300° C. at 750 mtorr pressure of a hydrogen/tungsten hexafluoride mixture was used to deposit the tungsten film.

Finally, aluminum lands were deposited at each end over the surface of the tungsten bridge layer to produce the bridge device of the present invention. The aluminum lands were deposited by conventional deposition techniques.

This tungsten bridge was assembled into a test device filled with a pyrotechnic powder pressed to a density of 2.2 $Mg/m^3$. Experiments demonstrated that the bridge could ignite the powder at an energy of approximately 7 mJ. The function time for the device was 40 microseconds.

EXAMPLE 2

A tungsten bridge device was fabricated in accordance with the procedure of Example 1. The bridge was 150 micrometers wide by 300 micrometers long. The tungsten thickness was estimated at 0.28 micrometers and the bridge device had an initial resistance of about 5 ohms. The bridge was fabricated using tungsten chemical vapor deposition techniques on a matching 2 micrometer thick, undoped silicon bridge structure on a sapphire substrate. Bridges formed in this manner were examined with high-speed photography and four-lead electrical measurements during firing. A series of tests were carried out including both normal firing and subthreshold current levels.

It was found that the electrical potential across the tungsten element rose to about 65 volts during the initial heating. The current, initially in the range of 10 amps, increased to 30 amps later in the discharge. The energy dissipated in the bridge during the pulse was 7.2 mJ. The impedence of the device rose from 3 to 8 ohms during the initial heating at which point the impedence dropped to below 2 ohms as the arc began to carry the discharge current. Of the 7.2 mJ energy input to the bridge element over the full pulse width, only 1.2 mJ was required to reach the arc discharge state.

Tests were also run at subthreshold voltages to attempt to burn out the bridge prior to forming the conductive plasma event in order to find out if a fuse type burnout of the tungsten element would be a significant problem. A test was fired at a charge voltage of 30 volts and produced a current of approximately 5 amps in the bridge. The dynamic impedence of the device increased from the initial value of 3 ohms to a value of 6 ohms during the discharge due to the temperature-dependent resistivity of tungsten thin film. After the tests, the resistance of the bridge was found to be about 2.5 ohms indicating that there was no tendency to open the bridge circuit at high subthreshold current levels because of the refractory properties of tungsten metal.

EXAMPLE 3

In this example, an explosive experiment was carried out with a tungsten bridge device fabricated in accordance with Example 1. In this experiment, 100 mg of $TiH_{1.68}KClO_4$ was pressed against the bridge at a pressure of 40 MPa in a standard test fixture. This test revealed that the tungsten bridge device of the present invention could ignite pyrotechnic powder at energies of less than 4 mJ and had function times of 63.1 and 64.5 microseconds.

The foregoing description of embodiments of the invention has been presented for purposes of illustration and description. It is not intended to be exhaustive or to limit the invention to the precise forms disclosed, and many modifications and variations will be obvious to one of ordinary skill in the art in light of the above teachings. The scope of the invention is to be defined by the claims appended hereto.

What is claimed is:

1. A tungsten bridge device for the low energy ignition of explosive and energetic materials, said device comprising:

a substrate;

an electrical bridge on the surface of and substantially electrically insulated from the substrate, said bridge consisting of:

a first bridge-shaped layer of an insulating material in contact with said substrate, said material intrinsically conducting when heated, and a second layer of tungsten selectively deposited only over said entire first layer;

a pair of conductive lands located over said tungsten layer, said lands being spaced from each other; and a pair of electrical conductors, one conductor being connected to each of said lands.

2. A tungsten bridge device as claimed in claim 1 further comprising an additional insulating layer between said substrate and said bridge.

3. A tungsten bridge device as claimed in claim 1 wherein said insulating material of said first layer of said bridge is silicon.

4. A tungsten bridge device as claimed in claim 2 wherein said lands comprise aluminum.

5. A tungsten bridge device as claimed in claim 4 wherein said substrate comprises silicon.

6. A tungsten bridge device as claimed in claim 5 wherein said first layer of said bridge comprises silicon.

7. A tungsten bridge device as claimed in claim 3 wherein said tungsten layer is a thickness sufficient to produce a resistance of less than 10 ohms.

8. A tungsten bridge device as claimed in claim 3 wherein said tungsten layer is from about 0.1 to about 0.5 micrometers in thickness.

9. A tungsten bridge device as claimed in claim 8 wherein said first layer is from about 1 to about 3 micrometers in thickness.

10. A tungsten bridge device as claimed in claim 4 wherein said substrate comprises sapphire.

11. A method of manufacturing metal film bridge devices for the ignition of explosive and energetic materials comprising the steps of:

defining a bridge shape from a first material on an insulating substrate, said first material being an insulator that intrinsically conducts when heated;

selectively depositing a layer of tungsten over the entire bridge shape; and depositing a pair of conductive lands over the tungsten layer such that said lands are spaced apart one from another.

12. A method in accordance with claim 11 wherein said step of depositing a layer of tungsten comprises chemical vapor deposition.

13. A method in accordance with claim 12 wherein said step of defining a bridge shape comprises integrated circuit processing.

14. A method in accordance with claim 13 further comprising the step of depositing an oxide layer on the surface of the insulating substrate before said defining step.

15. A method in accordance with claim 11 wherein said first material is silicon.

16. A method in accordance with claim 15 wherein said substrate is sapphire.

* * * * *